US005366540A

United States Patent [19]

Bojsen

[11] Patent Number: 5,366,540

[45] Date of Patent: Nov. 22, 1994

[54] RAPPING MECHANISM FOR RAPPING THE ELECTRODES OF AN ELECTROSTATIC PRECIPITATOR

[75] Inventor: Erik M. Bojsen, Valby, Denmark

[73] Assignee: FLS MILJØ A/S, Denmark

[21] Appl. No.: 112,859

[22] Filed: Aug. 26, 1993

[30] Foreign Application Priority Data

Aug. 28, 1992 [DK] Denmark ..... 1076/92

[51] Int. Cl.[5] ..... B03C 3/76

[52] U.S. Cl. ..... 96/33; 96/38; 96/87; 96/92

[58] Field of Search ..... 96/32, 33, 37, 38, 92, 96/93, 86, 87, 83; 95/74, 76

[56] References Cited

U.S. PATENT DOCUMENTS

| | | | |
|---|---|---|---|
| 1,903,640 | 4/1933 | Wintermute | 96/32 |
| 3,729,815 | 5/1973 | Quintilian et al. | 96/37 X |
| 3,844,742 | 10/1974 | Petersen | 96/35 |
| 4,093,431 | 6/1978 | Frauenfelder | 96/34 |
| 4,218,225 | 8/1980 | Kirchhoff et al. | 96/32 |
| 4,263,023 | 4/1981 | Schminke | 96/38 |
| 4,502,870 | 3/1985 | Wheeler | 96/33 X |
| 4,671,808 | 6/1987 | Goransson | 96/38 |

FOREIGN PATENT DOCUMENTS

| | | | |
|---|---|---|---|
| 398476 | 11/1990 | European Pat. Off. . | |
| 2180172 | 3/1987 | United Kingdom . | |
| 523712 | 9/1976 | U.S.S.R. | 96/32 |

OTHER PUBLICATIONS

Duda, *Cement Data Book*, pp. 596–598 (3d Ed., Bauverlag GmbH., Wiesbaden and Berlin 1985).

*Primary Examiner*—Richard L. Chiesa
*Attorney, Agent, or Firm*—Brumbaugh, Graves, Donohue & Raymond

[57] ABSTRACT

A mechanism for rapping the electrodes of an electrostatic precipitator for the purpose of dislodging dust deposited on the electrodes is disclosed. The rapping mechanism incorporates a pair of impact beams (1, 1') between which collecting electrodes are suspended. The impact beams are so arranged that the beams slide on the upward-facing edges of a pair of support carriers (2, 2') secured to the precipitator housing. A drop hammer (7) rotatable about a horizontal shaft raps an anvil (6) secured to the impact beam pair (1, 1'), thereby causing a horizontal vibration of the impact beam pair (1, 1') without imparting any impact energy to the precipitator housing. A pair of springs (12) secured to the precipitator housing, one at each end of the impact beam pair, act against the horizontal movement of the impact beam pair and restore the impact beam pair to its original position.

6 Claims, 3 Drawing Sheets

RAPPING MECHANISM FOR RAPPING THE ELECTRODES OF AN ELECTROSTATIC PRECIPITATOR

BACKGROUND OF THE INVENTION

The invention relates to a rapping mechanism for rapping or vibrating the electrodes, preferably the collecting electrodes, also known as collector electrodes, of a high-voltage supplied electrostatic precipitator for the cleaning of smoke gases from industrial plants, power plants, etc. Such rapping is necessitated by the fact that, due to the way in which the precipitator operates, dust is deposited on the precipitator electrodes which must consequently be cleaned regularly of this dust during operation. The cleaning is achieved by a transmission of impact energy to the electrodes thus exposing the latter to intensive vibration whereby the deposited dust is released.

The impact energy required for rapping or vibrating the electrodes is usually produced by a number of hammers being lifted by a rotating shaft extending across the precipitator width from their vertically suspended position and subsequently being released so as to revert to their vertical position. For each hammer an impact rod or an impact beam is provided which is hit by the hammer when the latter reverts to its vertical position and from the impact rod/beam the supplied impact energy is then transmitted to a section of precipitator electrodes.

The collecting electrodes usually consist of vertically suspended, narrow and substantially rectangular plates which, at their upper ends, are secured to a suspension device in a precipitator housing containing the electrodes. The latter may be arranged in mutually parallel rows or precipitator sections and the rapping is effected for the separate sections by means of drop hammers and impact rods for each section.

Rapping mechanisms of this type are known, e.g. from Duda: "Cement Data Book", 3rd edition, pp 596–598 (Bauverlag GmbH - Wiesbaden und Berlin 1985), and from patent disclosures Nos. U.S. Pat. No. 3,844,742 and EP-A-0,398,476.

In the so-called European type electrostatic precipitators drop hammers and impact rods which are connected to the lower ends of the collecting electrodes are generally used. This results in a disadvantage that the hammers and their carrier bridges occupy comparatively much space at the end of and below the precipitator sections which, in turn, presupposes an increased length and height of the precipitator housing containing the sections. In the so-called American type electrostatic precipitators the rapping of the electrodes is often effected from the top of the precipitator, the rapping mechanism then being mounted externally on top of the precipitator housing and the rapping being effected by means of small, vertically mounted impact rods which hit the electrode suspension device vertically. In this case each impact rod is provided with slide sealings around the passage through the precipitator housing roof. Certain types of "American" precipitators may alternatively be provided with a vertically acting rapping mechanism mounted inside the precipitator housing and which actuates the electrodes axially.

In order to avoid absorption of the impact energy by the precipitator housing construction the so-called European type as well as the American type precipitators may have insulators and protective spring elements, discs or leaf springs mounted between the housing construction and the rapping mechanism. It is a disadvantage of the American-type precipitators that a fracture in the rapping mechanism, which also acts as suspension device for the electrodes, may cause the latter to fall from the relevant precipitator section with the ensuing risk of causing a short-circuit and power cuts with a resulting precipitator shutdown. In case of American-type precipitators having the rapping mechanism mounted on top of the precipitator housing roof, the volume occupied by the aggregate precipitator construction in the relevant plant is substantially increased.

It is a further disadvantage of the above-mentioned hitherto known electrostatic precipitators that some of the impact energy which actuates the electrodes is immediately transmitted to the supporting construction of the precipitator construction thereby reducing the lifetime of the precipitator housing, irrespective of any optional damping of said energy by means of the inserted spring systems, and wherein energy which may usefully be used for electrode vibration is lost.

It is therefore the object of the present invention to provide a rapping mechanism for electrodes, preferably collecting electrodes, in an electrostatic precipitator, and which remedies the above-mentioned disadvantages of the prior art technique.

SUMMARY OF THE INVENTION

The object is achieved by means of a rapping mechanism of the type consisting of a drop hammer (7) rotatable about a horizontal shaft, a pair of impact beams (1, 1') so arranged that the beams slide on the upward-facing edges of a pair of support carriers (2, 2') secured to the precipitator housing, and an anvil (6) secured to the impact beam pair (1, 1'). Collecting electrodes are suspended between the impact beam pair (1, 1'). The drop hammer raps the anvil, thereby causing a horizontal vibration of the impact beam pair (1, 1'). The impact beams are hereby separated from the supporting construction of the precipitator whereby the impact energy imparted to the impact beams by the drop hammers is not transmitted to the supporting construction contrary to the hitherto known precipitator constructions, and so that fractures, if any, in the impact beams do not result in the collecting electrodes falling and causing short circuit in the electrostatic precipitator.

BRIEF DESCRIPTION OF THE DRAWINGS

The invention will be explained in more detail in the following with reference to the drawings which are examples and non-limiting illustrations of embodiments of the invention, and wherein.

DESCRIPTION OF THE PREFERRED EMBODIMENTS

Figure 1:
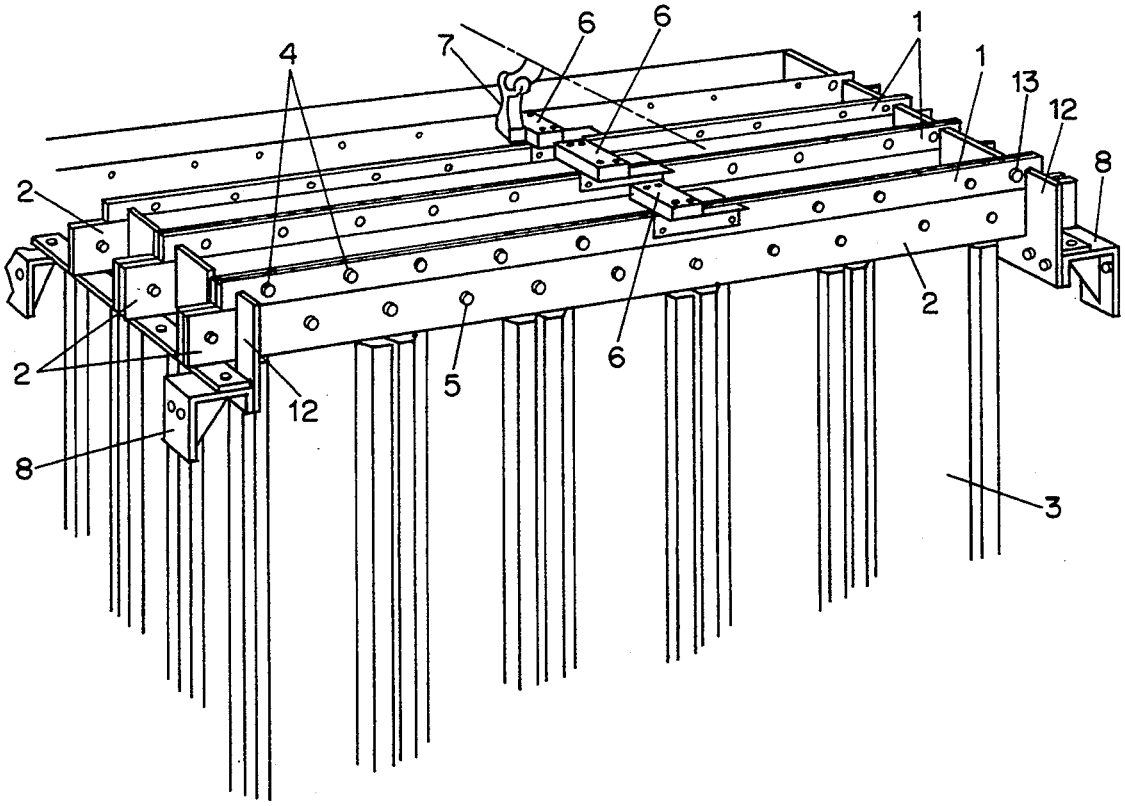
FIG. 1 is a perspective view of a part of the upper portion of an electrostatic precipitator and showing three precipitator sections.
Figure 2A:
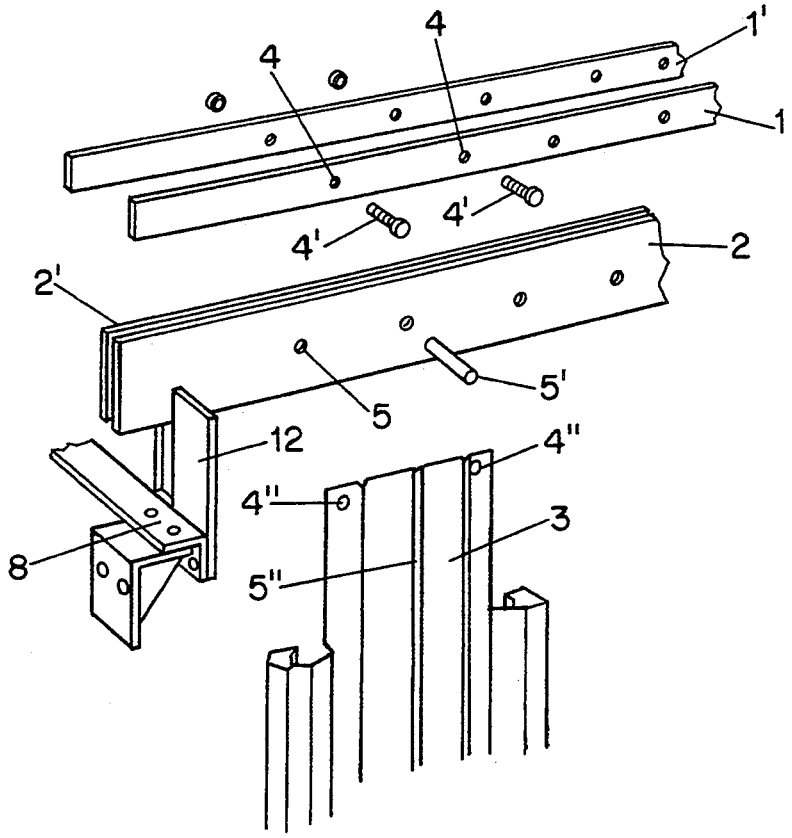
FIGS. 2A, 2B and 2C are also perspective and partially exploded views of a suspension of a collecting electrode in a rapping mechanism according to the invention.

As shown in FIGS. 1 and 2A the rapping mechanism of a precipitator comprises two impact beams or carriers 1,1' which in their mounted position in the precipitator housing each rests upon a support carrier 2,2' at the top of a precipitator section, and wherein the support carriers constitute a part of the precipitator frame construction, an anvil 6 and a drop hammer 7 which, during use, is caused to rotate about a not shown horizontal axis above the precipitator sections. The support carriers 2,2' surround in pairs the upper end of the electrodes 3 of a precipitator section and rest at each end on angular support irons 8 which are secured to a not shown wall construction of the precipitator housing. The support carriers 2,2' are provided with assembly holes 5 wherein assembly bolts 5' may be inserted. When an electrode 3 is to be suspended its one end is moved upwards between two carriers 2,2' together forming a carrier pair and are secured temporarily to the latter by means of an assembly bolt 5' which is placed in the assembly hole 5 of the one carrier 2 and is then passed through a corresponding assembly hole 5'' in the electrode 3 and finally into an assembly hole 5 in the other carrier 2' of the carrier pair.

Figure 2B:
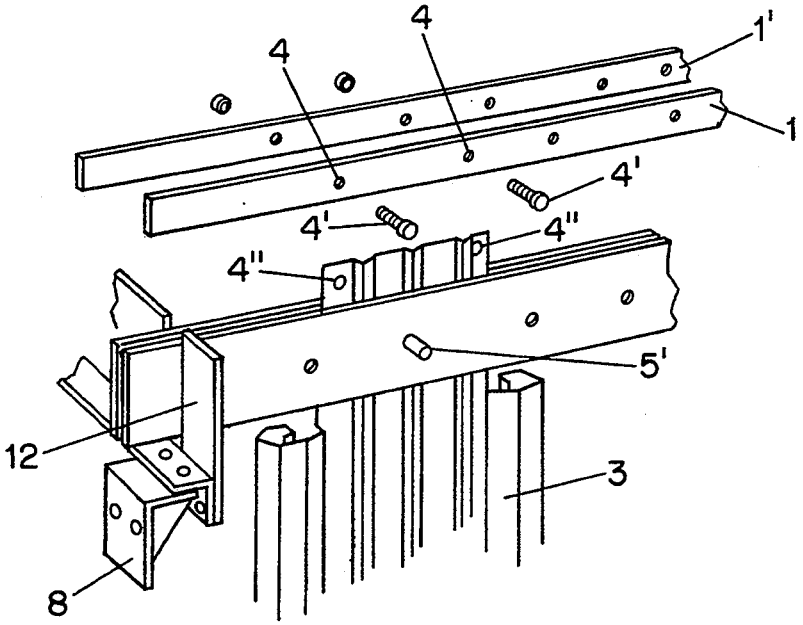
Figure 2C:
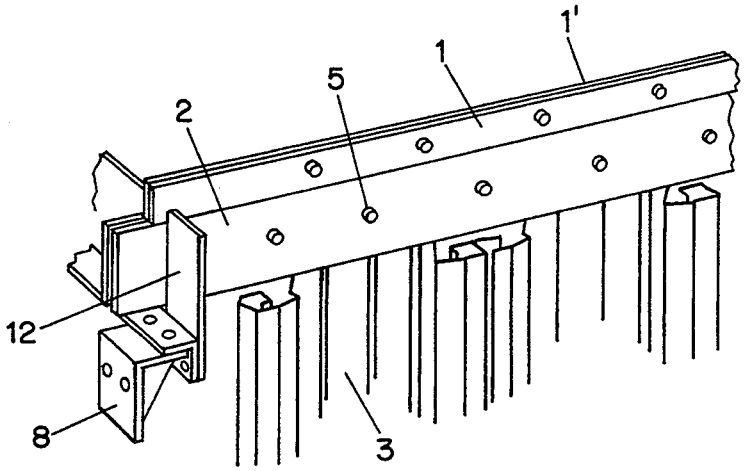

Thus, with the upper end of the electrode extending upwards through the carrier pair 2,2', cf. FIG. 2B, the beam pair 1,1' of the rapping mechanism is restingly placed upon the upward-facing edges of the carrier pair 2,2' and on each side of the electrode 3. By means of securing bolts 4' which are inserted into securing holes 4 in the beams 1,1' and 4'' in the electrode the latter is suspended in the beam pair 1,1', cf. FIG. 2C, whereupon the assembly bolt 5' is removed from the electrode and the support carriers 2,2' so that the electrode is now suspended from the beam pair 1,1' only.

With the anvils 6 secured, e.g. by welding, on the upward-facing edges of the beam pairs 1,1' so as to make the anvils form abutments for the drop hammers 7, the drop hammer transmits, by rotation about their rotational shaft, impact energy to the anvils 6 which energy actuates the beams 1,1' horizontally and thus vibrates the electrodes suspended in the beams. As it appears most clearly from FIG. 1 the supplied impact energy will make the beams 1,1' slide to the right on the upwards facing edges of the carriers 2,2'. This movement of the beams 1,1' is caught by bias element leaf springs 12 being secured to angular support irons 8, each of said beams 1,1' being at their ends provided with transversal bolts 13 which, by the movement, are caused to abut the leaf springs 12 which thus catch the movement of the beams 1,1' and recoil the latter to their starting position before the anvil 6 is again hit by the drop hammer 7.

Figure 3:
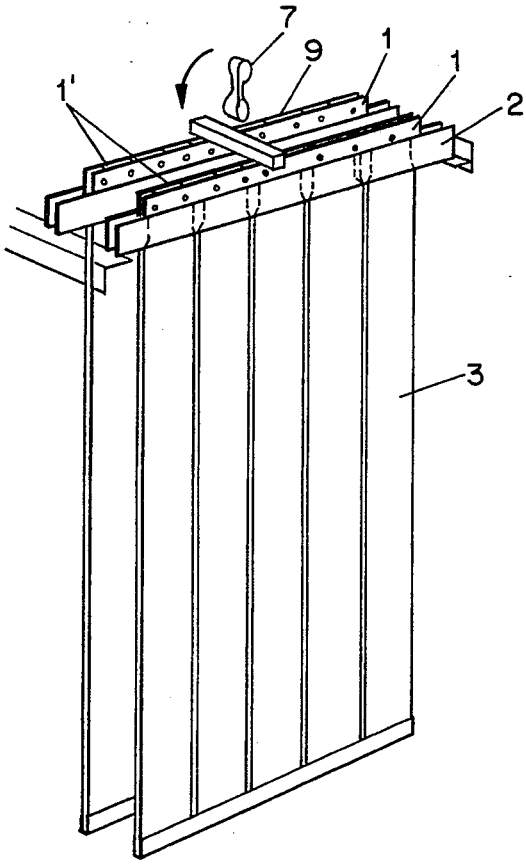
FIG. 3 is a perspective view of a rapping mechanism having a common anvil for two precipitator sections.

As will appear from FIG. 3, an anvil may be of such length that it is secured to several (in the figure two) adjacent impact beam pairs 1,1' whereby the rapping of corresponding adjacent precipitator section electrodes is effected simultaneously. This construction is particularly suitable where a precipitator with only moderate rapping is required.

Figure 4:
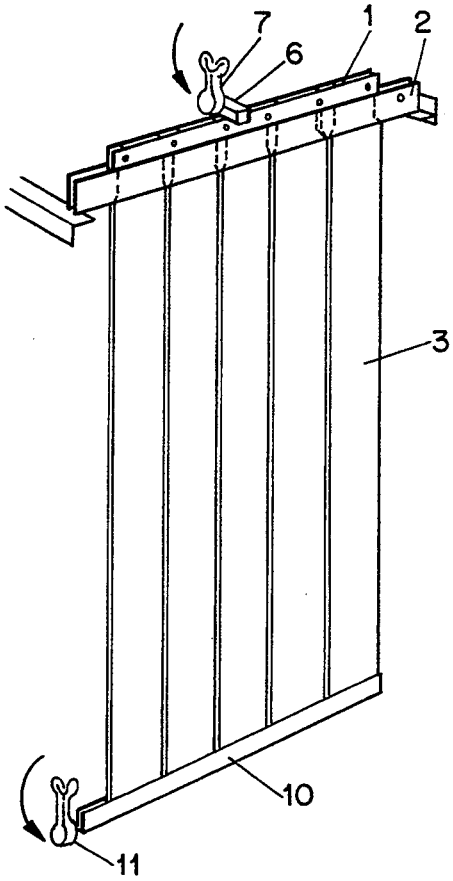
FIG. 4 is a precipitator section with a rapping mechanism according to the invention and supplemented with a known rapping mechanism acting upon the lower part of the section.

In the embodiment shown in FIG. 4 a rapping mechanism (1,6,7) according to the invention is combined with a rapping mechanism (10,11) of a known type and coupled to the lower ends of the electrodes 3. This construction is used in precipitators wherein a particularly high level of rapping is desired, presupposing, however, larger precipitator housing dimensions in order to make space for the lower rapping mechanism. The rapping level may be further increased through a convenient synchronization of the abutment of the drop hammers 7,11 against the anvil 6 and the rods 10, respectively.

As will appear from the above the rapping mechanism according to the invention represents in particular several advantages.

The impact energy from the drop hammers is transmitted directly to the electrodes without actuating the precipitator housing construction proper.

As the impulse time for the individual rapping or vibrating is very short the friction between the impact beams (1,1'), and the support carriers (2,2') will have no significant influence.

The rapping mechanism may be integrated into existing electrostatic precipitator housings requiring only insignificant modifications of their constructions.

The noise level of the rapping mechanism is significantly lower than the noise level of corresponding known rapping mechanisms being mounted on the exterior of a precipitator housing, even in case of precipitators with no screening roofs or walls.

I claim:

1. A rapping mechanism for rapping or vibrating collecting electrodes of an electrostatic precipitator, said electrostatic precipitator comprising a housing, and collecting electrodes, wherein the collecting electrodes (3) comprise vertically suspended, substantially rectangular plates, and a pair of horizontally arranged support carriers (2,2') having a top surface and a bottom surface, the support carriers being secured to the precipitator housing and surrounding the upper ends of the electrodes (3), wherein the rapping mechanism comprises:

a drop hammer (7) with means for horizontally rapping the collecting electrodes, the drop hammer being rotatable about the cylindrical axis of a horizontal shaft;

a pair of impact beams (1,1') having a top surface and a bottom surface, between which impact beams the collecting electrodes are suspended, wherein the bottom surface is slidably positioned on the top surface of the pair of support carriers (2,2') such that the impact beams are horizontally slidable;

an anvil (6) secured to the top surface of the impact beam pair (1,1'); and a pair of bias elements (12) fixed to the precipitator housing and engaging the longitudinal ends of the impact beam pair (1,1'), for moving the impact beams (1,1') back to their starting position after a horizontal rapping or vibrating movement.

2. A rapping mechanism according to claim 1, further comprising means to synchronize the hammer impacts at the top and at the bottom, respectively, of the electrodes (3), whereby the respective hammer impacts to the anvils (6,9) and to the lower impact rods (10) are separated by a selected time interval.

3. A rapping mechanism according to claim 1, wherein the anvil (9) is secured to a plurality of pairs of impact beams perpendicularly to the length of the impact beams (1,1').

4. A rapping mechanism according to claim 3, further comprising means to synchronize the hammer impacts at the top and at the bottom, respectively, of the electrodes (3), whereby the respective hammer impacts to the anvils (6,9) and to the lower impact rods (10) are separated by a selected time interval.

5. Amended) A rapping mechanism according to either of claims 1 or 3, further comprising impact rods (10) secured to the lower ends of the electrodes, said impact rods having an abutment formed at least at one of their longitudinal ends.

6. A rapping mechanism according to claim 5, further comprising means to synchronize the hammer impacts at the top and at the bottom, respectively, of the electrodes (3), whereby the respective hammer impacts to the anvils (6,9) and to the lower impact rods (10) are separated by a selected time interval.

* * * * *